US008430002B2

(12) United States Patent
Wasinger

(10) Patent No.: US 8,430,002 B2
(45) Date of Patent: Apr. 30, 2013

(54) FASTENING APPARATUS WITH PLUNGING MEMBER

(75) Inventor: Eric M. Wasinger, Bexar County, TX (US)

(73) Assignee: Toyota Motor Engineering & Manufacturing North America, Inc., Ann Arbor, MI (US)

( * ) Notice: Subject to any disclaimer, the term of this patent is extended or adjusted under 35 U.S.C. 154(b) by 180 days.

(21) Appl. No.: 12/917,975

(22) Filed: Nov. 2, 2010

(65) Prior Publication Data

US 2012/0102660 A1 May 3, 2012

(51) Int. Cl.
*B25B 13/02* (2006.01)

(52) U.S. Cl.
USPC ..... 81/124.2; 81/125

(58) Field of Classification Search ..... 81/124.1, 81/124.2, 124.4, 124.6, 125
See application file for complete search history.

(56) References Cited

U.S. PATENT DOCUMENTS

| | | | | |
|---|---|---|---|---|
| 1,394,539 | A | 10/1921 | Danielson | |
| 2,239,548 | A | 4/1941 | Butler et al. | |
| 2,628,523 | A | 2/1953 | Williams | |
| 3,376,765 | A | 4/1968 | Ruby | |
| 4,357,845 | A * | 11/1982 | Cornia | 81/125 |
| 4,535,657 | A * | 8/1985 | Farris | 81/124.1 |
| 5,263,390 | A | 11/1993 | Levy et al. | |
| 6,711,974 | B1 * | 3/2004 | Lin | 81/125 |
| 2009/0151519 | A1 * | 6/2009 | Monyem | 81/124.4 |
| 2010/0005932 | A1 * | 1/2010 | Young et al. | 81/124.2 |
| 2010/0058900 | A1 * | 3/2010 | Dahar et al. | 81/455 |

* cited by examiner

*Primary Examiner* — David B Thomas

(74) *Attorney, Agent, or Firm* — Christopher G. Darrow; Young Basile

(57) ABSTRACT

A fastening apparatus includes a fixed body with a first end and a second end, wherein the first end defines a groove for receiving a pin, and a movable body having a coupling end and a receiving end, the coupling end coupled to the second end of the fixed body. The fastening apparatus further includes a socket disposed on the receiving end of the movable body, the socket capable of receiving a fastener, wherein an edge of the socket defines an aperture to align with a pin. The fastening apparatus further includes a plunging member disposed with in the movable body, the plunging member coupled to the fixed body, wherein the plunging member is utilized to apply pressure to the fastener.

18 Claims, 3 Drawing Sheets

FASTENING APPARATUS WITH PLUNGING MEMBER

TECHNICAL FIELD

The present disclosure relates generally to the field of fastening apparatus, and more specifically, to fastening apparatus for fastening cotter pins.

BACKGROUND

A fastening apparatus may be utilized in the manufacturing industry to fasten a variety of parts in the building and assembly process. Various types of fastening apparatus, including wrenches and pliers, may be utilized in the automotive manufacturing process, for example, to fasten a lug nut, such as those used to secure a wheel of an automobile, while on a manufacturing assembly line. Sometimes, fasteners may be used in combination with fastening apparatus to ensure that a particular piecework is securely fastened. For example, a castellated nut may be fastened with a cotter pin to secure ball joint attachments.

Some common fasteners used in manufacturing may include pins and nuts. Generally, a pin may be a single or multi-tined fastener made from rigid material, which is passed through a hole or holes to secure a piecework. A pin, such as a cotter pin, for example, may be a two-tined fastener. In an installation process, a pin may be passed through a hole or holes and the tines of the pin may be bent to fix the pin in a secure position, thus fastening a piecework. The tines may be bent using tools such as pliers, prongs, or the like. The pin may be further secured by striking the pin with a tool such as a hammer or the like to ensure the pin is adequately bent.

Nuts are another common type of fastener used in manufacturing. A nut may be a fastener with a threaded hole commonly used with a bolt to fasten a piecework. Torque may be applied to the nut to secure it with the bolt, thus fastening a piecework. Torque may be applied by hand, or more preferably, using a tool such as one of a variety of wrenches (e.g. crescent wrench, boxed-end wrench, open-end wrench, torque wrench, etc.), a drill, a ratchet, pliers, or the like. The edges of a nut may be smooth, or may be notched with any number of notches. A nut with a notch or notches may be referred to as a castellated nut or slotted nut. A castellated nut may be used with a bolt that contains one or more holes through its threaded end. After coupling the castellated nut to the bolt, the hole or holes in the bolt may align with a notch in the castellated nut. If a hole in the bolt does not align with the desired notch in the castellated nut, the nut may be rotated so that the hole aligns with a notch. A tool such as one previously mentioned may be used to adjust the alignment of the castellated nut. Once the hole and the notch are aligned, a pin, such as a cotter pin, may be used to further secure the castellated nut. A pin may be passed through a notch of the castellated nut, through a hole or holes of the bolt and through the notch on the opposite side of the castellated nut. The tines of the pin may then be bent to securely fasten the castellated nut. As mentioned previously, the pin may require additional pressure or striking in order to bend the pin into a secure position. A hammer or the like may be used to strike the pin. Additionally, the pin may need to be laid in a particular position, such as flat against a piecework, or oriented in a downward position so that the pin will not snag on other parts.

During the manufacturing process, several combinations of fasteners may be used repeatedly. For example, a castellated nut and a cotter pin may be used to fasten a ball joint attachment and this may be repeated for each ball joint attachment. It is desirable for quality control purposes that fasteners be laid and fastened in a proper and consistent manner. Currently, multiple tools may be required to fasten a particular fastener or combination of fasteners. As each tool is used, the fastening process may vary considerably for each fastener resulting in inconsistent laying and fastening.

Additionally, it is desirable in manufacturing to streamline processes and minimize manufacturing time. Sometimes, different tools may be required to fasten different fasteners. Manufacturing time is lost when switching tools. For example, it may take several seconds or more to fasten a cotter pin using pliers, then put down the pliers and search for a hammer to further secure the cotter pin. Sometimes adjustments may be required to ensure proper alignment of combinations of fasteners, such as when fastening a castellated nut with a cotter pin. Once a cotter pin is placed through a castellated nut, it may be desirable to fasten the cotter pin tines in a downward position so as not to snag on other parts. Additional manufacturing time is lost when adjustments are made. Thus, a need exists for improved apparatus for consistently fastening fasteners in an efficient mariner.

SUMMARY

The following presents a general summary of several aspects of the disclosure in order to provide a basic understanding of at least some aspects of the disclosure. This summary is not an extensive overview of the disclosure nor is it intended to identify key or critical elements of the disclosure or to delineate the scope of the claims. The following summary merely presents some concepts of the disclosure in a general form as a prelude to the more detailed description that follows.

One aspect of the present disclosure provides for a fastening apparatus including a fixed body with a first end and a second end, wherein the first end defines a groove for receiving a pin, and a movable body having a coupling end and a receiving end, the coupling end coupled to the second end of the fixed body. The fastening apparatus further includes a socket disposed on the receiving end of the movable body, the socket capable of receiving a fastener, wherein an edge of the socket defines an aperture to align with a pin. The fastening apparatus further includes a plunging member disposed with in the movable body, the plunging member coupled to the fixed body, wherein the plunging member is utilized to apply pressure to the fastener.

Another aspect of the present disclosure provides for a fastening apparatus including a fixed body with a first end and a second end, wherein the first end defines a groove thereon for receiving a pin. The fastening apparatus includes a movable body having a coupling end and a receiving end, the movable body movable from a decompressed position to a compressed position, the coupling end coupled to the second end of the fixed body. The fastening apparatus further includes a plunging member coupled to the fixed body and disposed within the movable body and a socket disposed on the receiving end of the movable body, the socket capable of receiving a threaded fastener wherein an edge of the socket defines an aperture, the socket further capable of receiving the plunging member when the movable body is in the compressed position.

A further aspect of the present disclosure provides for a fastening apparatus including a fixed body with a first end and a second end, wherein the first end defines a groove thereon for receiving a pin. The fastening apparatus includes a movable body having a coupling end and a receiving end, the movable body movable from a first position to a second position, the coupling end coupled to the fixed body at the second end. The fastening apparatus further includes a disk disposed on the fixed body, a plunging member coupled to the fixed body and disposed within the movable body, and a socket disposed on the receiving end of the movable body, the socket capable of receiving a nut and wherein an edge of the socket defines an aperture to align with a pin.

BRIEF DESCRIPTION OF THE DRAWINGS

For detailed understanding of the present disclosure, references should be made to the following detailed description of the several aspects, taken in conjunction with the accompanying drawings, in which like elements have been given like numerals and wherein.

DETAILED DESCRIPTION

Figure 1:
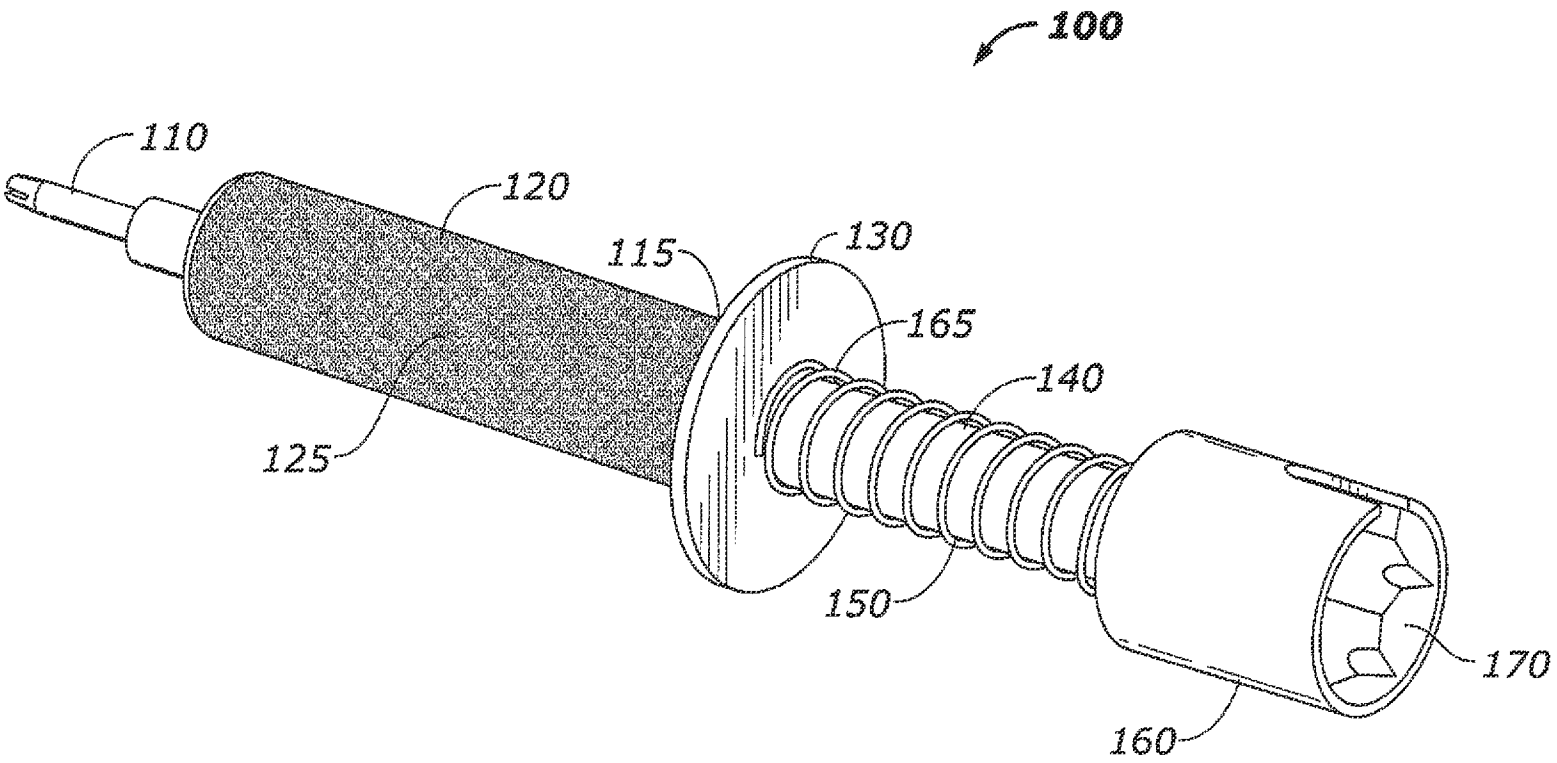
FIG. 1 provides an isometric view of a fastening apparatus in accordance with one aspect of the present disclosure.

Before the present apparatus are described, it is to be understood that this disclosure is not limited to the particular apparatus described, as such may vary. One of ordinary skill in the art should understand that the terminology used herein is for the purpose of describing possible aspects, embodiments and/or implementations only, and is not intended to limit the scope of the present disclosure which will be limited only by the appended claims.

It must also be noted that as used herein and in the appended claims, the singular forms "a," "an," and "the" may include plural referents unless the context clearly dictates otherwise. Thus, for example, reference to "a socket" may refer to one or several sockets and reference to "a method of receiving" includes reference to equivalent steps and methods known to those skilled in the art, and so forth.

This disclosure is not limited in its application to the details of construction, and the arrangement of components set forth in the following description or illustrated in the drawings. The disclosure is capable of other embodiments, implementations or aspects and of being practiced or of being carried out in various ways. Also, the use of "including," "comprising," "having," "containing," "involving," "consisting" and variations, thereof, is meant to encompass the items listed thereafter and equivalents thereof as well as additional items.

FIG. 1 represents an isometric view of a fastening apparatus, generally indicated at 100, in accordance with one aspect of the present disclosure. The fastening apparatus 100 may be made of any suitable rigid material including, but not limited to, metal, metal alloy, steel, aluminum, or the like. As shown, the fastening apparatus 100 may include a fixed body 120 coupled to a movable body 140. The fixed body 120 may be elongated and have a first end 110 and a second end 115. The movable body 140 may have a coupling end 165 and a receiving end 160. It should be understood that the present disclosure has applicability to fastening apparatus 100 as broadly described herein, and is not intended to be limited to the fastening apparatus 100 or its elements specifically described.

The fixed body 120 provides a surface onto which a user may contact and/or grip the fastening apparatus 100. The fixed body 120 may define additional features such as grooves or elements to facilitate the gripping of the fastening apparatus 100, which may not be shown in FIG. 1. In one implementation, the fixed body 120 may be covered with a grippable material 125 for gripping the fastening apparatus 100. As used herein, cover may mean to place or overlay material on the fixed body 120, such as by adhesive or any suitable means. The grippable material 125 may be natural or synthetic or a combination thereof, and may include fabric, paint, rubber, rubberized fabric, plastic, leather, or the like. Additionally, the material may provide a smooth or textured finish.

The second end 115 of the fixed body 120 may be coupled to the coupling end 165 of the movable body 140 via a connecting means. The connecting means may include welding, glue, fasteners, heat bonding, or the like. The movable body 140 may include an elastic member 150, which may further interconnect the fixed body 120 to the movable body 140, providing a means for which the movable body 140 can move relative to the fixed body 120. The movable body 140 may move from a first position, such as where the elastic member 150 is decompressed, to a second position, such as where the elastic member 150 is compressed (position not shown). When the elastic member 150 is in the compressed position, the movable body 140 may move into or towards the fixed body 120. Accordingly, the fixed body 120 may be hollow or the second end 115 of the fixed body 120 may provide a space into which part of the movable body 140 may retract.

Disposed on the movable body 140, as seen in FIG. 1, on the receiving end 160 is a socket 170. The socket 170 (further described in FIG. 2) is capable of receiving a fastener or combination of fasteners. Fasteners may include, but are not limited to wires, bolts, nuts, and pins. Generally, pins may include single or multi-tined fasteners made from rigid material. In one implementation, a pin may be a cotter pin. A cotter pin may be a two-tined fastener, which is passed through a hole or holes to secure a piecework. The cotter pin body may be comprised of a single piece of suitable rigid material including, but not limited to, metal, metal alloy, steel, aluminum, or the like bent during installation, into a hole, for example, used to fasten metal together. The cotter pin may be bent to form two tines substantially parallel to one another in a shape such as a U-shape, V-shape, R-shape, or the like. In the installation process, the cotter pin may be passed through a hole or holes and the tines may be bent to fix the cotter pin in a secure position. Typically, tines may be bent using a tool such as pliers or prongs. The tines may be generally elongated and may be tapered, waved, or include curvatures and may be of varied sizes and widths. Both tines may be of equal length or one tine may be longer than the other. A cross-section of the tine itself may be substantially semi-circular, circular, rectangular, or any other shape. Cotter pins may also be referred to as cotter keys or split pins.

A nut may be a fastener with a threaded hole commonly used with a bolt to fasten a piecework. Torque may be applied to the nut to secure it to the bolt, thus fastening a piecework. Torque may be applied by hand, or utilizing a tool such as a wrench (e.g. crescent wrench, boxed-end wrench, open-end wrench, torque wrench, etc.), a drill, a ratchet, pliers, or the like. A nut may be made from any suitable rigid material including, but not limited to, metal, metal alloy, steel, brass or the like. In one implementation, the edges of a nut may be smooth. In another implementation, the edges of the nut may be notched with any number of notches. A nut with a notch or notches may be referred to as a castellated nut or slotted nut. A castellated nut may be used with a bolt that contains one or more holes through its threaded end. After coupling the castellated nut with the bolt, the hole or holes in the bolt may align with a notch in the castellated nut. If a hole in the bolt does not align with the desired notch in the castellated nut, the nut may need to be rotated so that the hole aligns with a notch. A tool such as one previously mentioned may be used to adjust the alignment of the castellated nut. Once the hole and, the notch are aligned, a cotter pin may be used to further secure the castellated nut. A cotter pin may be passed through a notch of the castellated nut, through a hole or holes of the bolt and through the notch on the opposite side of the castellated nut. The tines of the cotter pin may be bent to securely fasten the castellated nut. The socket 170 may also be capable of receiving other fasteners or fastener accessories such as washers or inserts.

A disk 130 of metal may be disposed on the fixed elongated body 120 at the second end 115, as shown in FIG. 1. In some implementations, the disk 130 may be disposed anywhere on the fixed body 120 or movable body 140. The disk 130 may serve as the connecting means by which the fixed body 120 is coupled to the coupling end 165. The disk 130 may be made of the same material as the fixed elongated body 120 or may be formed from any other material including, but not limited to, metal, metal alloy, steel, aluminum, any resilient material or the like. The disk 130 may be substantially round or oval in shape, and oriented substantially perpendicular relative to the length of the elongated body 120. Gripping the fastening apparatus 100 by the fixed body 120, a user's hand may encounter the disk 130 which may prevent the fastening apparatus 100 from slipping from the user's hand. The disk 130 may further guide or aid the user in positioning his or her hand when gripping the fastening apparatus 100.

Figure 2:
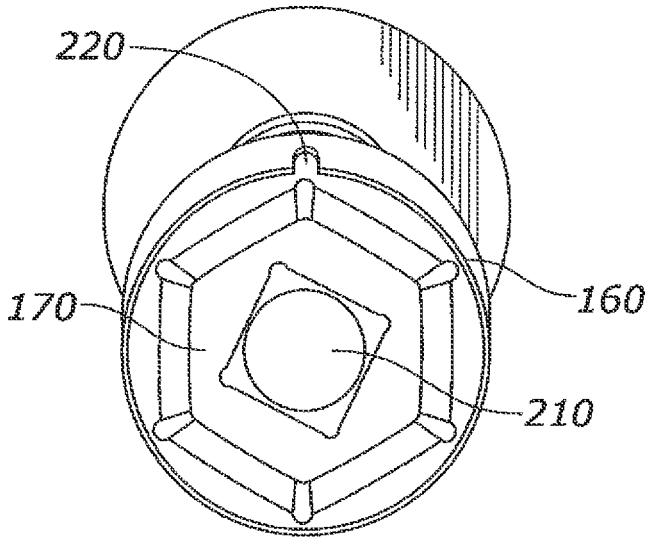
FIG. 2 provides a view of a receiving end of a movable body of the fastening apparatus of FIG. 1.

Turning to FIG. 2, the receiving end 160 of the movable body 140 is shown in detail, in accordance with one aspect of the present disclosure. Disposed on the receiving end 160 is a socket 170 capable of receiving a fastener or combination of fasteners. In one implementation, and as depicted in FIG. 2, the socket 170 may receive a castellated nut with six sides (i.e., a hex castle nut) in combination with a bolt and cotter pin. In other implementations, the nut may have any number of sides including four, six or eight.

The socket 170 may be capable of receiving specific fasteners or combinations of fasteners by further defining the socket. For example, the socket 170 may accommodate the collar of a nut, the domed top of an acorn nut, or various fastening inserts or other fastening accessories. The socket 170 may further accommodate only a specific orientation of fasteners such that the socket 170 will only fit on a particular fastener or group of fasteners when such fasteners are arranged in a particular way. An aperture 220 in the edge of the socket may be defined to receive a fastener that extends beyond what the socket 170 itself can accommodate. The aperture 220 may define a round hole, or a notch, a U, V, or other shape that may receive a fastener. In one implementation, shown in FIG. 2, the socket 170 may receive a hexagonal castellated nut while the aperture 220 may receive a fastener, such as the tines of a cotter pin that are inserted through the nut. In other implementations, multiple apertures may be present, or no apertures may be present.

Within the movable body 140 is a plunging member 210. The plunging member 210 may be elongated and may be made of suitable rigid material including, but not limited to, metal, metal alloy, steel, aluminum, or the like. The plunging member 210 may be coupled to the second end 115 of the fixed elongated body 120 via a connecting means. The connecting means may include welding, glue, fasteners, heat bonding, or the like. When the elastic member 150 is in a decompressed position, the plunging member 210 may rest within the movable body 140. When the elastic member 150 is in a compressed position, the movable body 140 may recede into the fixed body 120. As the movable body 140 moves towards the first end 110 of the fixed body 120, the plunging member 210 emerges from the movable body 140 into the inside of the socket 170. The plunging member 210 may protrude into the socket 170. A user may grip the fastening apparatus 100 at the fixed body 120. The user may position the socket 170 over the desired fastener combination or arrangement. In one implementation, the fastener combination may be a castellated nut coupled with a cotter pin. After coupling a castellated nut with a bolt, the hole or holes in the bolt may align with a notch in the castellated nut. A cotter pin may be passed through a notch of the castellated nut, through a hole or holes of the bolt and through the notch on the opposite side of the castellated nut. A user may position the socket 170 over a fastener or combination of fasteners. For example, a user may position the socket 170, over a hexagonal castellated nut with a cotter pin through it. The aperture 220 may be capable of receiving the tines of a fastener such as a pin or a wire when the fastener is in a particular direction. Then by gripping the fixed body 120 of the fastening apparatus 100 the user may apply pressure to the moveable body 140 such that the elastic member 150 may move from a decompressed to a compressed position. Once pressure is applied to the elastic member 150, the plunging member 210 may extend into the socket 170. Pressure from the plunging member 210 on the fastener or fastener combination may fix the fasteners into any desired position or orientation. Pressure from the plunging member 210 exerted on the fastener or fasteners may also further fix the fasteners in a secure position.

Figure 3:
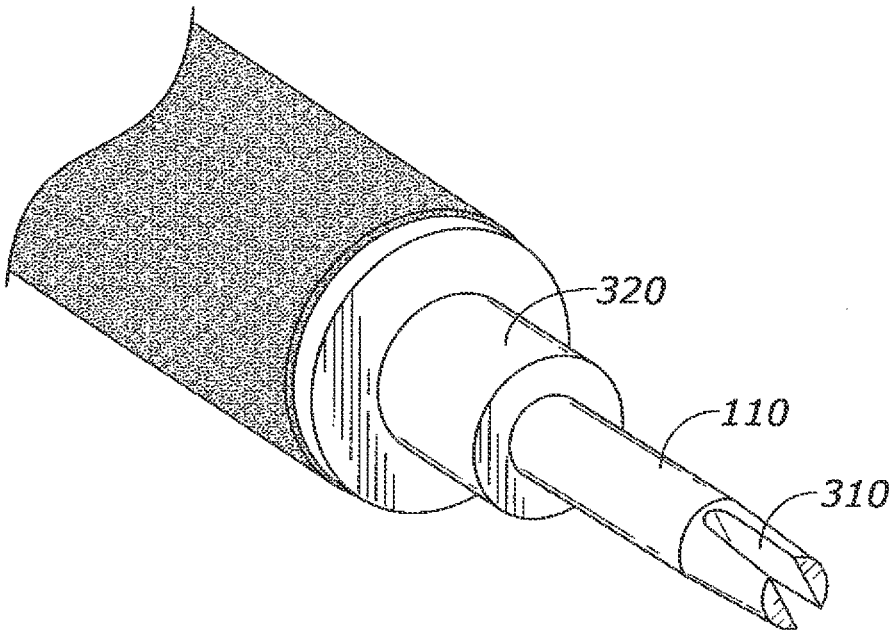
FIG. 3 provides a view of a first end of a fixed body of the fastening apparatus of FIG. 1.

Referring now to FIG. 3, the first end 110 of the fixed-body 120 is shown in detail. The first end 110 defines a groove 310 thereon capable of receiving a fastener. Generally, the first end 110 defines a groove having a U-shape, V-shape, or any other shape cross-section capable of receiving a fastener. In one implementation, groove 310 may be capable of receiving a wire fastener. In another implementation, the groove 310 may be capable of receiving a pin, such as a cotter pin, for example. The groove 310 may fit around a fastener enabling a user to manipulate the fastener in a desired manner. For example, a user may grip the fixed body 120 of the fastening apparatus 100 aiming the first end 110 at a target fastener. The user may then position the groove 310 on the fastener and turn the fastening apparatus 100 at an angle to bend the fastener into a desired position such as a secured position. A groove 310 may be capable of receiving multiple types of fasteners.

In one implementation, the first end 110 may be disposed on a reinforcement body 320. The reinforcement body 320 may be coupled to the fixed body 120. The reinforcement body 320 may be made from the same material as the fixed body 120 and/or the first end 110, and may be made of suitable rigid material including, but not limited to, metal, metal alloy, steel, aluminum, or the like. As depicted, the reinforcement body 320 may be cylindrical in shape. In other implementations, the reinforcement body 320 may be any other shape that provides reinforcement to the first end 110. The reinforcement body 320 may reinforce the first end 110, providing additional strength to the first end 110 to withstand force from use. In another implementation, the reinforcement body 320 may not be present. In yet another implementation, the first end may be an extension of the fixed body 120. For example, the fixed body 120 may be tapered, the tapered portion comprising the first end 110. The groove 310 may be disposed on the first end 110.

Figure 4:
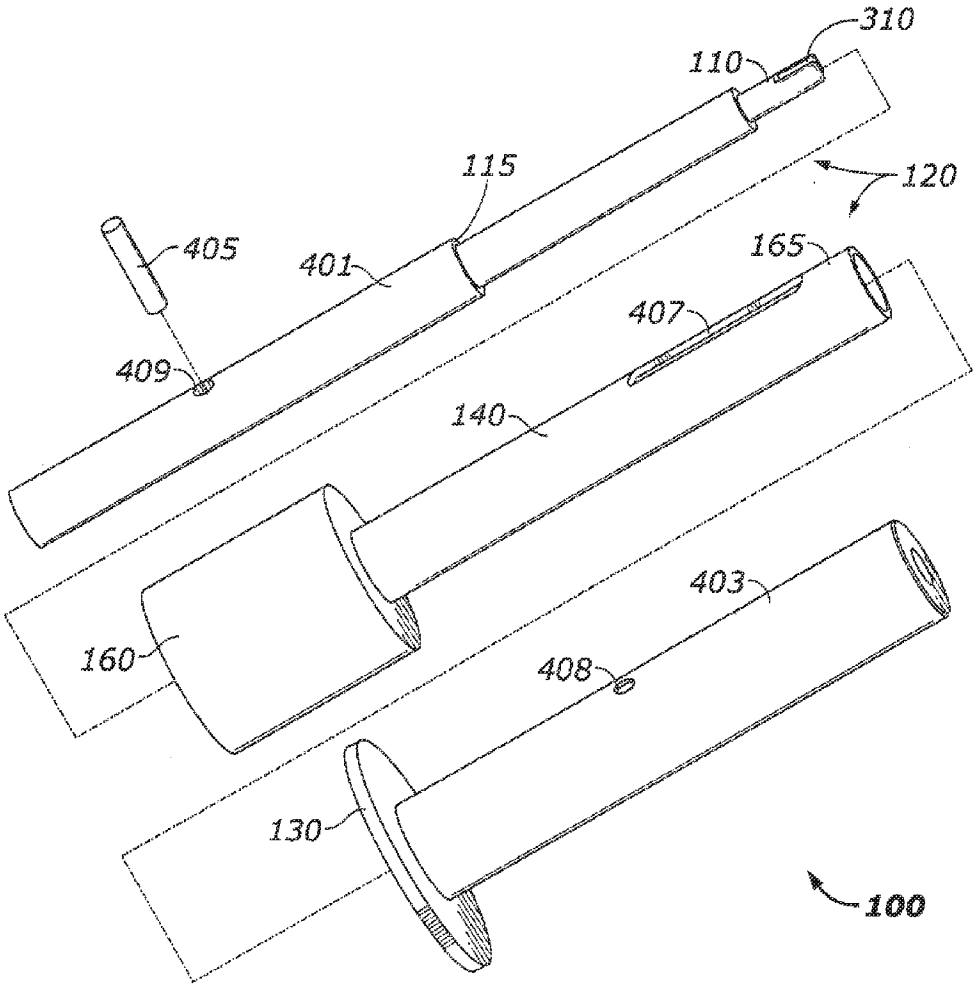
FIG. 4 provides an exploded view of the fastening apparatus of FIG. 1.

Referring now to FIG. 4, the fastening apparatus 100 of FIG. 1 is shown in exploded view. As discussed in FIG. 1, the fastening apparatus 100 may include a movable body 140 and a fixed body 120. The fixed body 120 may have a first end 110 and a second end 115. Further, the fixed body 120 may be comprised of a rod portion 401 and a handle portion 403. The rod portion 401 may be elongated and have a first end 110, such as one with a groove 310 for receiving a fastener or a pin. The rod portion 401 may define an opening 409 into which a pin fastener 405 may fit. A pin fastener 405 may be a pin such as a spring pin or cotter pin. In one implementation, the pin fastener 405 may be a spring pin which provides tension on the rod portion 401 and other parts of the fastening apparatus 100 that the pin fastener 405 may fasten. The handle portion 403 of the fixed body 120 may be elongated and have a second end 115. The handle portion 403 may be at least partially hollow such that at least the rod portion 401 or part of the rod portion 401 may fit inside the handle portion 403. The handle portion 403 may define an opening 408 similar to the opening 409 defined in the rod portion 401. The opening 408 may be such that a pin fastener 405 may fit through the opening 408.

As discussed in FIG. 1, the movable body 140 may have a coupling end 165 and a receiving end 160. With reference to FIG. 4, the movable body 140 may further define a slot 407. The slot 407 may have a width that is wider than the openings 408, 409 defined in the fixed body 120. The slot 407 may be generally elongated in shape, in one implementation. In one implementation, the slot 407 is defined towards the coupling end 165 of the movable body 140.

The movable body 140 may be hollow, such that the rod portion 401 of the fixed body 120 or a part of the rod portion 401 of the fixed body 120, may fit inside the movable body 140 at the coupling end 165. Further, the handle portion 403 of the fixed body 120 may be hollow such that the movable body 140 or a part of the movable body 140 may fit within the handle portion 403 of the fixed body 120 at the second end 115. The rod portion 401 and the handle portion 403 of the fixed body 120 and the movable body 140 may align such that the openings 408, 409 and slot 407 align. When aligned, a pin fastener 405 may be passed through the openings 408, 409, and the slot 407 to slideably fasten the fixed body 120 and the movable body 140.

The movable body 140 may include an elastic member 150 (not show in FIG. 4). The elastic member 150 may place tension on the fixed body 120 such that the pin fastener 405 may travel within the slot 407 and towards the coupling end 165 of the movable body 140. When pressure is placed on the receiving end 160 of the movable body 140, the elastic member 150 may move from a decompressed to a compressed position. When the elastic member 150 is in a compressed position, the pin fastener 405 may travel within the slot 407 towards the receiving end 160 of the movable body 140.

The handle portion 403 of the fixed body 120 may be covered with a grippable material 125 (not shown in FIG. 4). Further, in the implementation depicted, a disk 130 is disposed on the second end 115 of the fixed body 120. In other implementations, the disk 130 may be disposed on other areas of the fixed body 120 or on the movable body 140.

Apparatus disclosed herein may comprise a fixed body coupled to a movable body for receiving and/or securing fasteners in an efficient manner.

What is claimed is:

1. A fastening apparatus comprising:

a fixed body with a first end and a second end, wherein the first end defines a groove shaped to receive a pin;

a movable body having a coupling end and a receiving end, the coupling end coupled to the second end of the fixed body;

an elastic member extending from the second end of the fixed body to the receiving end of the movable body;

a socket disposed on the receiving end of the movable body, the socket capable of receiving a fastener, wherein an edge of the socket defines an aperture shaped to receive a pin extending from the fastener; and a plunging member disposed within the movable body, the plunging member coupled to the fixed body, wherein the plunging member extends into the socket when the elastic member is compressed for applying pressure to the fastener.

2. The apparatus of claim 1, wherein the plunging member recedes within the socket when the elastic member is decompressed and the movable body is in a decompressed position.

3. The apparatus of claim 1, further comprising a disk disposed on the fixed body.

4. The apparatus of claim 3, wherein the disk is disposed on the second end of the fixed body.

5. The apparatus of claim 3, wherein the disk is couples the fixed body to the coupling end of the movable body.

6. The apparatus of claim 3, wherein the disk is used to strike a fastener into a desired position.

7. The apparatus of claim 1, wherein the fixed body is covered with a grippable material.

8. A fastening apparatus comprising:

a fixed body with a first end and a second end, wherein the first end defines a groove thereon shaped to receive a pin;

a movable body having a coupling end coupled to the second end of the fixed body and a receiving end;

an elastic member coupling the second end of the fixed body and the receiving end of the movable body wherein the movable body is movable from a decompressed position to a compressed position based on compression of the elastic member;

a plunging member coupled to the fixed body and disposed within the movable body; and a socket disposed on the receiving end of the movable body, the socket capable of receiving a threaded fastener wherein an edge of the socket defines an aperture, the socket further capable of receiving the plunging member when the movable body is in the compressed position.

9. The apparatus of claim 8, further comprising a disk disposed on the fixed body.

10. The apparatus of claim 8, wherein the disk is used to strike a fastener into a desired position.

11. The apparatus of claim 8, wherein the fixed body is covered with a grippable material.

12. The apparatus of claim 8, wherein the socket is shaped to receive a castellated nut.

13. The apparatus of claim 8, wherein the aperture is shaped to receive a cotter pin.

14. The apparatus of claim 8, wherein the groove is shaped to receive a cotter pin.

15. A fastening apparatus comprising:

a fixed body with a first end and a second end, wherein the first end defines a groove thereon for receiving a pin;

a movable body having a coupling end and a receiving end, the movable body movable from a first position to a second position, the coupling end coupled to the fixed body at the second end;

a disk disposed on the fixed body;

a plunging member coupled to the fixed body and disposed within the movable body; and a socket disposed on the receiving end of the movable body, the socket capable of receiving a nut and wherein an edge of the socket defines an aperture to align with a pin.

16. The apparatus of claim 15, wherein the movable body is movable by an elastic member coupling the fixed body to the movable body.

17. The apparatus of claim 15, wherein the disk is disposed on the second end of the fixed body.

18. The apparatus of claim 15, wherein the movable body is capable of moving from a decompressed position to a compressed position.

* * * * *